US005362177A

United States Patent [19]

Bowhall et al.

[11] Patent Number: 5,362,177

[45] Date of Patent: Nov. 8, 1994

[54] PAVING METHOD AND APPARATUS WITH FRESH MAT PROFILER

[75] Inventors: Garry Bowhall, Champaign; Loren E. Williams, Olney, both of Ill.

[73] Assignee: Blaw-Knox Construction Equipment Corporation, Matoon, Ill.

[21] Appl. No.: 17,799

[22] Filed: Feb. 16, 1993

[51] Int. Cl.[5] ..... E01C 23/01

[52] U.S. Cl. ..... 404/84.1; 404/101

[58] Field of Search ..... 404/83, 84.05, 84.1, 404/84.2, 101, 118

[56] References Cited

U.S. PATENT DOCUMENTS

| | | | |
|---|---|---|---|
| 3,259,034 | 7/1966 | Davin | 404/83 |
| 3,602,113 | 8/1971 | Davin | 404/84.2 |
| 3,675,545 | 7/1972 | Anderson et al. | 404/105 |
| 3,771,892 | 11/1973 | Munyon et al. | 404/84.1 |
| 3,846,035 | 11/1974 | Davin | 404/84.1 |
| 5,107,598 | 4/1992 | Woznow et al. | 33/521 |

*Primary Examiner*—Ramon S. Britts
*Assistant Examiner*—James A. Lisehora
*Attorney, Agent, or Firm*—Pearne, Gordon, McCoy & Granger

[57] ABSTRACT

An asphalt paver tows a device which measures smoothness of the fresh mat laid by the paver. The device measures the distance between the mat and a datum line as a function of paver position. Preferably, the rear reference beam of a dual reference beam paver is provided with a smoothness sensor. The rear beam is supported on two shoes riding on a fresh mat laid by the paver. A device to measure the distance from the beam to the mat such as a potentiometer is located near the center of the rear beam. The potentiometer has its shaft connected to a shoe by a lever so that vertical movement of the shoe rotates the shaft. Movement of the shoe is plotted against movement of the paver determined by a forward travel sensor. The plot shows smoothness of the mat.

11 Claims, 3 Drawing Sheets

PAVING METHOD AND APPARATUS WITH FRESH MAT PROFILER

BACKGROUND OF THE INVENTION

1. Field of the Invention

This invention relates generally to floating screed pavers and specifically to a smoothness feedback system for such pavers.

2. Description of the Related Art

In the laying of asphalt pavement roadways and the like, it is widespread practice to employ so-called floating screed paving machines. These machines include a tractor-like main frame having an engine for propulsion and for material distributing functions. Typically, there is a material receiving hopper at the front of the paver arranged to receive hot asphalt material from a truck as the paving machine advances along the roadbed. Slat conveyors or the like are provided to convey the material from the hopper, at the front of the machine, toward the floating screed, at the back of the machine. Immediately in front of the screed, there is typically provided a distributing auger, which receives the raw asphalt material from the slat conveyor and conveys it laterally so as to distribute the material along the front edge of the screed. As the machine advances along the prepared roadbed, the raw asphalt material flows under the screed, which levels, smooths and compacts it to provide a continuous, level pavement mat.

In a typical floating screed asphalt paver, the screed is attached to a pair of forwardly extending tow arms which engage the paver frame at their forward extremities. These tow arms are also connected to the paver frame by hydraulic or other actuators arranged to adjust the vertical position of the tow arm extremities in relation to the paver frame. By effecting proper control over the position of the tow arm forward extremities, the screed is maintained in relation to a reference plane or a reference element substantially independent of the irregular vertical motions of the paver frame itself. Thus, it is possible to cause the floating screed to lay a pavement mat which is smooth and level in relation to the underlying base surface.

Effective control of the screed may be achieved by means of a suitable position sensing device, for example, which is carried by one or both of the tow arms or other forward projections of the screed and arranged for contact with a predetermined reference surface. When the position sensing device becomes either higher or lower than is indicated by the reference surface, as with changing loads upon paver frame and/or irregularities in the roadbed surface, the tow point is caused to be controllably raised or lowered relative to the paver frame to maintain a constant relationship between the position sensing device, called the grade sensor, and the reference. In many applications, grade control is provided at only one side of the machine. For controlling the other side, there typically may be provided a so-called slope control, which functions to maintain a constant relationship between screed ends at opposite sides, either on a level basis or with a predetermined transverse slope.

In conjunction with the type of tow point control mentioned in the preceding paragraph, it is important to provide an appropriate reference for the position sensing device.

It has proven advantageous to utilize a mobile reference beam, which is carried along with the paver as it moves over the roadway base surface. An arrangement of this type is described and claimed in U.S. Pat. No. 3,259,034 to Davin, which is assigned to the assignee hereof and is incorporated herein by reference. In the arrangement of the Davin patent, an elongated beam structure is provided with a substantial plurality (e.g., ten) of independent supports, advantageously arranged on individual springs. The arrangement is such that, as the reference beam is carried along the base surface, it is supported by the combined action of the multiple, yieldable supports. The individual supports are enabled to follow the minor deviations in base contour without significantly affecting the position of the reference beam as a whole, and the mobile reference beam thus provides a suitably accurate, averaged reference plane representing the grade to which the pavement mat is to be applied. A sensing device carried by forward projections of the screed engages the reference beam near its center, to enable the screed to be maintained in a predetermined relationship to the moving reference beam.

U.S. Pat. No. 3,846,035 to Davin, which is assigned to the assignee hereof and is incorporated herein by reference, disclosed a moving reference beam arrangement in connection with the laying of wide pavement mats, utilizing a combination of reference beams, one being towed ahead of the screed and auger, supported on the roadway base grade, and the other being towed behind the screed and auger, supported on the just-laid asphalt mat. To greatest advantage, the arrangement of the Davin '035 device includes a system of compound levers associated with the respective leading and trailing reference beams and arranged to derive a signal which is a function of the relationship of the screed and its tow arms to the respective reference beams. In effect, the reference beam arrangement is of greatly increased length and enables the laying of a mat of increased smoothness and accuracy in comparison to prior arrangements.

The trailing reference beam, which is towed by the paver frame behind the auger and screed is supported by one or more shoes or wheels. In the case of either the leading or trailing reference beams, or both, it is considered preferable to utilize a rigid beam with independently yieldably moveable supports.

In its most advantageous form, the system includes leading and trailing reference beams of rigid structure, independently supported by a plurality of yieldable supports. The leading reference beam is supported by a plurality of shoes or plates, while the trailing beam is supported by a pair of shoes. Elongated reference arms extend rearwardly from the leading beam and forwardly from the trailing beam and are pivotally connected to one of the screed tow arms, advantageously at a point forward of the screed itself but well behind the tow point. Thus, the reference arm pivot point is in a position to reflect deviations from the reference level of both the tow point and the screed itself.

After a pavement is laid by a machine similar to those described above, one of the most important measures of the quality of the newly paved road surface is smoothness, that is, the number and size of bumps and dips in the pavement. Smooth roads require less maintenance and help conserve fuel. They also provide for a more comfortable ride. Because of the importance of smooth roads, most contractors must adhere to strict specifications concerning the smoothness of the roads they construct. A road which does not meet the specifications may result in the forfeiture of part of the contract price or may require grinding or filling parts of the pavement, both of which are costly to the contractor. On the other hand, pavement which exceeds specifications for smoothness may result in bonus payments to the contractor. Thus, it is desirable to obtain smoothness data on a newly paved road to determine whether specifications are being met.

A number of devices have been used for measuring the smoothness of a road. The most common currently in use is the profilograph, which is an elongated beam or frame supported on several wheels. The beam establishes a datum from which deviations in the road surface can be measured. A sensing wheel rolls on the surface and moves vertically as it travel over bumps and dips in the road. Originally, profilographs were entirely mechanical devices which used a linkage to transmit the vertical movement of the sensing wheel to a pen which traced a plot of the road surface on a moving roll of paper. Such a plot is analyzed by laying a template with a "blanking band" over the plot. The blanking band defines a tolerance and blanks out minor aberrations.

Profilographs have advanced to the point where data from the sensing wheel is transmitted electrically and can be printed or stored in a computer for later analysis. Some computers provide the capability to automatically analyze the plot by applying an electronic blanking band.

Profilographs have proven to be useful in measuring the smoothness of a fresh asphalt mat, however, they are generally not used until several hours or even days after the mat has been laid and rolled. It is desirable to obtain smoothness data for a fresh mat immediately after it has been laid prior to rolling so that the mat can be worked while it is still plastic. Also, it is desirable to know if the paver or crew are not paving properly before an entire job is completed so that corrections can be made for the remainder of the job.

Since pavers are not equipped to directly sense the location of the screed relative to the reference, a position of the tow arm, forward of the screed, is typically used to sense screed position. Complete precision in controlling the screed is not possible because of inherent problems in mechanical linkages which are used. Thus, immediate smoothness data can help improve paver performance by immediately indicating problems with screed control which affect smoothness. For improved efficiency, it is preferred that the smoothness data is collected as an integral part of the paving operation.

SUMMARY OF THE INVENTION

The present invention is a method of paving a base surface with a moving vehicle. The paving material is distributed and substantially levelled. A reference line is established parallel with the direction of motion of the vehicle and the distance from the top of the levelled paving material to the reference line is measured while the paving material is still plastic.

The invention also comprehends an apparatus for paving a base surface including a movable vehicle capable of distributing paving material. A floating screed is disposed so as to form a substantially level mat of the paving material. A means to establish a reference line substantially parallel to the direction of motion of the vehicle is provided. Also provided is a means to measure a distance from the reference line to the mat of paving material.

In the preferred embodiment, the present invention is an improved dual reference beam grade control system for use in combination with an asphalt paver of the type having a transversely disposed material distributing auger, a floating screed positioned behind the auger, two tow arms extending forwardly from the screed and connected to the paver frame, and tow arm suspension means for vertically adjusting the tow point connections of said tow arms to effect changes in the attitude angle of the screed. The grade control system includes a first reference member towed by the paver frame and extending longitudinally along one side thereof. The first reference member is disposed entirely forward of the auger. The first reference member is provided with a plurality of independently movable, ground engaging supports which are spaced along its length to support said reference member at an averaged position above a base grade surface. A first reference arm is pivotally connected to the first reference member in its central region. The first reference arm extends rearwardly toward and is pivotally connected to said tow arm. A second reference member is towed by the paver frame and is disposed entirely behind the screed. Ground engaging means for supporting said second reference member above an asphalt mat surface are provided. A second reference arm connected to the second reference member extends forwardly toward and is pivotally connected to said tow arm and/or said first reference arm. A tow arm height reference control means associated with each of said reference arms and operatively associated with said tow arm suspension means is provided for raising and lowering the tow point of said tow arm relative to the paver frame in response to relative movements of one or both of said reference arms in relation to said tow arm. The improvement is a means to measure a distance from a reference point on the second reference member to the asphalt mat surface.

The measuring means is a position sensor located near the center of the rear reference member or beam which includes a potentiometer mounted on the beam. The shaft of the potentiometer has a lever attached thereto. A ground engaging shoe is pivotally attached to the lever below the center of the beam so that vertical movement of the shoe rotates the potentiometer shaft. As the paver moves forward, the rear reference beam is moved over the fresh asphalt mat surface. The shoe moves vertically over the bumps and dips in the mat surface and, thus, the potentiometer shaft is rotated to vary the resistance of the potentiometer and provide an electrical indication of the height of the shoe. When the height of the shoe is plotted as a function of paver position, it provides a profile of the fresh asphalt mat. When a paver having forward and rear reference beams on both sides is used, one sensor is mounted on each of the rear beams.

The potentiometers and a forward travel sensor are connected to a microprocessor based circuit which analyzes the mat profile to determine the smoothness of the fresh mat. The profile and smoothness data can be displayed or stored and, under specified conditions can activate alarms or indicators. Stored data can be retrieved to create a graphic profile of the mat, which can be used to analyze paver or crew performance and the effects of various conditions present during paving. If a permanent benchmark is established at the beginning of the paving job, the graph can lead one back to a particular point on the mat for correction or analysis. A keyboard is also provided for operator input and control.

During a paving operation, the invention provides immediate feedback regarding the smoothness of the fresh asphalt mat. If the desired smoothness is not being achieved, the problem can be diagnosed and corrective action can be taken to ensure that the asphalt yet to be laid will be sufficiently smooth. If necessary, the asphalt already laid can be rolled or filled while it is still plastic.

To more fully automate the system, smoothness information can be connected to directly modify grade and/or slope control of the paver. In this way, human error and delayed response can be avoided.

For a better understanding of the invention and its various features and advantages, reference should be made to the following description of the preferred embodiment and accompanying drawings.

DESCRIPTION OF THE PREFERRED EMBODIMENT

Figure 1:
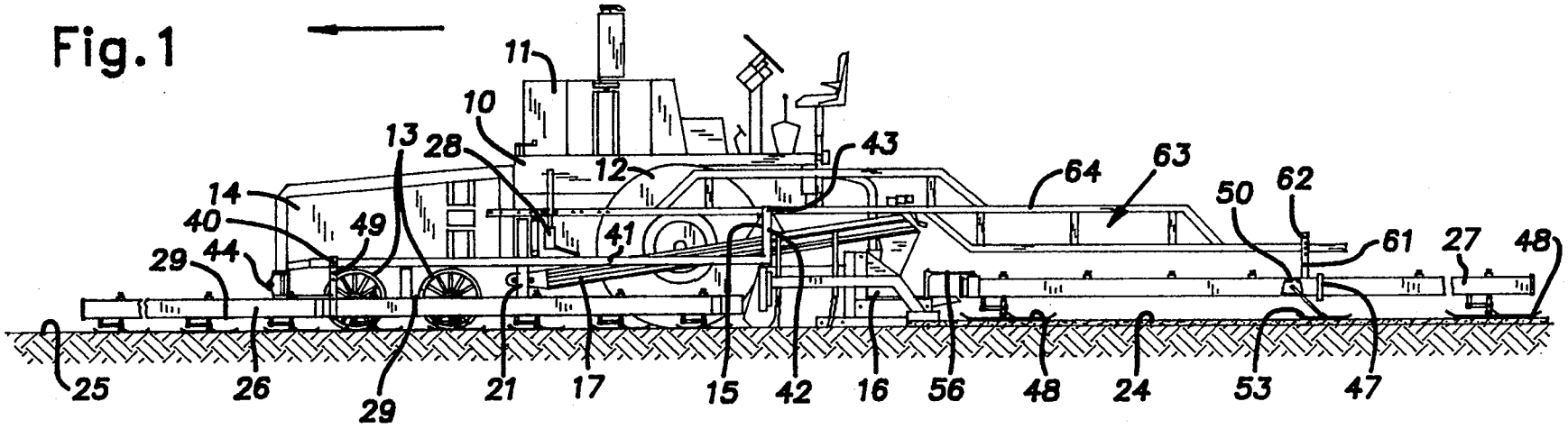
FIG. 1 is an elevational view of a floating screed type asphalt paver illustrated as in operation laying a pavement mat and utilizing a dual mobile reference beam arrangement according to the invention.

Referring now to the drawings, and initially to FIG. 1 thereof, the reference numeral 10 designates generally a paver frame of a floating screed type asphalt paver. The paver per se is well known in principle and includes an engine or prime mover 11 which provides a source of tractive power and also provides power for the various material conveying and distributing functions of the machine. In the illustrated apparatus, a pair of large, pneumatic tires 12 at the back of the paver provide the necessary forward traction, with steerage and support for the front of the paver being provided by pairs of smaller wheels 13.

In front of the paver 10, there is conventionally provided a hopper 14 arranged to receive paving material, which may be aggregate, asphalt, and the like, from the tilted body of a truck (not shown). In accordance with conventional practice, the truck is brought into contact with the front of the paver, and then is pushed along by the paver, continuously discharging its contents into the hopper 14 during the progress of the paving operation, until the complete truckload is exhausted. Thereafter, the empty truck is replaced by a new, fully loaded truck, with the paving operation continuing from the hopper supply during the changeover interval.

By means of a suitable slat conveyor (not shown) the paving material is conveyed from the hopper 14 to the back of the machine and deposited in front of a controllably rotated auger (not shown). The auger is pitched oppositely from the center, so as to convey the conveyor-discharged paving material laterally outward and distribute it more or less evenly along the full length of the auger. In this respect, it will be understood that the basic body of the paver frame 10 may have an overall width of 10 or 12 feet, for example, to accommodate its over-the-road transportation from place to place. At the same time, the paver may be and often is set up in a configuration to lay paving mats in an uninterrupted width of 20 to as much as 40 feet on occasion. In such cases, the overall width of the auger is substantially equal to the full paving width.

Disposed immediately behind the auger is a strike-off and screed structure generally designated by the numeral 16, which is carried by a pair of forwardly extending tow arms 17. The tow arms each have an upward extension 15 near the middle of the arms The screed assembly 16 like the auger, has a width corresponding to the desired paving width, and thus may be substantially wider than the width of the paver frame 10. The tow arms 17, are spaced so as to be closely adjacent to sides of the paver frame. Accordingly, the tow arm 17 may engage the screed assembly 16 well inboard of its lateral extremities. Intermediate portions of the tow arms extend upward and over the top of the area occupied by the auger.

Figure 5:
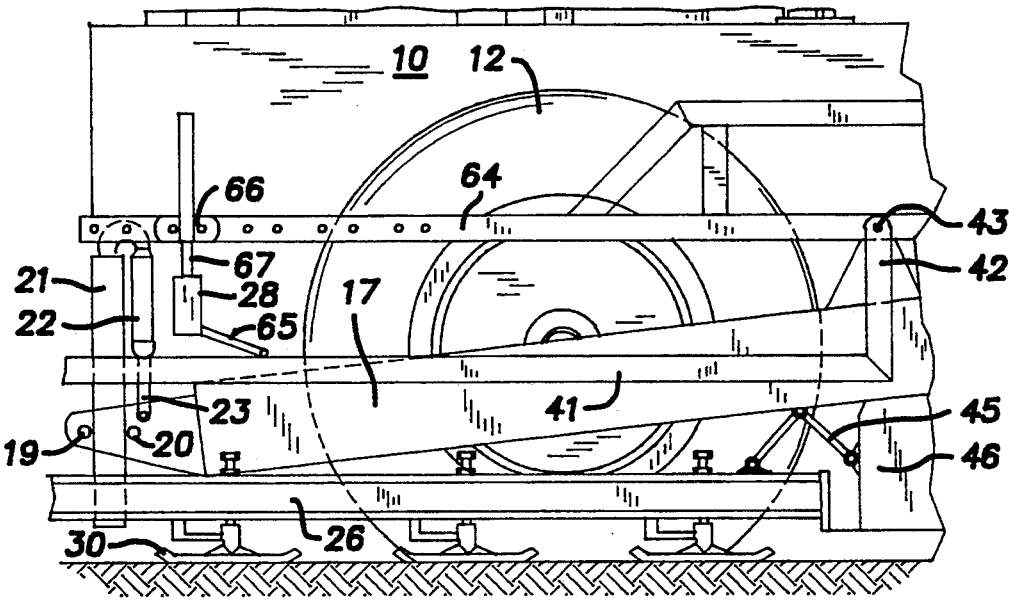
FIG. 5 is an enlarged, fragmentary elevational view illustrating details of the tow point suspension and reference signal means incorporated in the paving apparatus of FIG. 1.

With reference to FIG. 5, the tow arms 17 may be connected to the paver frame by means of spaced tow pins 19,20 which are freely slidable on a vertically disposed tow bar 21 in accordance with conventional practice. A hydraulic actuator 22 is mounted at the upper end of the tow bar 21, and extends downward with its rod 23 engaging the forward portion of the tow arm 17. By appropriate control of the actuator 22, the forward extremity of the tow arm may be appropriately raised or lowered in relation to the paver frame itself to effect desired adjustments in the angular attitude of the tow arms 17 and the screed assembly 16. Similar arrangements are, of course, provided at both sides of the machine, with the respective actuators being separately controllable, however, to provide for independent manipulation of tow arm elevation on opposite sides of the machine.

Returning to FIG. 1, a smooth, level mat 24 of paving material may be laid by the screed assembly 16 more or less independently of variations in the base roadbed 25 and also more or less independently of changes in the suspension of the paver frame 10 itself resulting from changing loads in the hopper 14, for example, or movement of the wheels into or over minor discontinuities or obstructions in the roadway. In accordance with well known principles, this is realized in part by providing a so-called grade reference level, which is independent of the paver frame 10, and by maintaining the tow point of at least one of the arms 17, at a predetermined height in relation to that reference. The other tow arm likewise may be controlled by a similar reference means, although it is usually more common to control one of the arms from a grade reference extending longitudinally of the roadway while controlling the other tow arm by means of a so-called slope control. If the slope angle is zero, both tow arms will automatically be adjusted to maintain both screed ends at an equal, uniform height in relation to a single grade reference. Frequently, however, a predetermined cross slope is built into the pavement surface, to facilitate drainage and/or for banking at turns. In the latter case, both tow arms can be adjusted in accordance with a single grade reference means, but the two screed ends will be maintained in an unequally spaced relation to that grade reference to provide the desired cross slope.

In accordance with the teachings of the beforementioned Davin U.S. Pat. No. 3,259,034, a suitable artificial grade reference may be derived from the base roadbed itself, by means of an elongated reference beam individually supported by a large plurality of independently yieldable supporting elements. The base road mat 25 may be a prepared but unpaved base, or may even be a previously laid asphalt course, where the finished pavement mat consists of more than one asphalt course.

The paving machine is provided with dual mobile reference beams 26 and 27 carried alongside and closely adjacent to the paver frame 10, with one reference beam 26 being carried forward of the auger-screed area and the second reference beam 27 being carried to the rear. At least the forward beam 26, and to best advantage each of the mobile reference beams, is of highly extended length, possibly greater than the length of the paver itself. In addition, the forward beam 26 is supported at a multiplicity of points along its length by equally spaced, independently movable supporting elements. The arrangement is such that the reference beam is supported in a position which represents an average condition of the underlying surface over an extended length. The function and operation of the forward or leading mobile reference beam 26 is similar to the reference beam described in U.S. Pat. No. 3,259,034 to Davin. The rear or trailing reference beam 27, on the other hand, instead of traveling along the base roadway 25 is arranged to travel along the just-laid asphalt paving mat, immediately behind the screed assembly 16. By an advantageous arrangement of reference arms or levers, reference data information from the respective beams 26 and 27 is combined and made available to a sensing device 28 to effect controlled movement of the actuator 22 and thereby maintain a constant relationship between the screed assembly 16 and the respective forward and rear reference beams 26 and 27.

Figure 2:
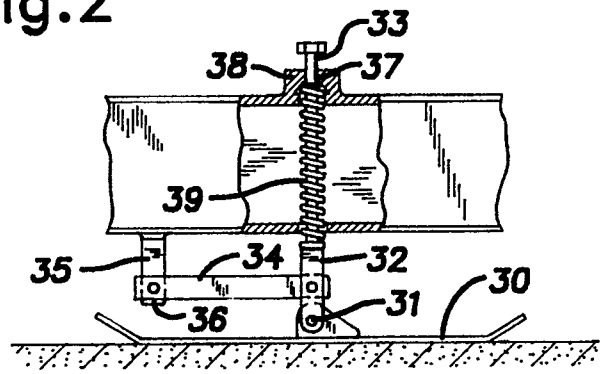
FIG. 2 is an enlarged, fragmentary elevational view, with parts broken away, illustrating an advantageous form of individual yieldable support for a reference beam.

In the illustrated form of the apparatus, the forward reference beam 26 is in the form of a three-piece lightweight tubular beam joined at flanges 29 into a unitary assembly. The segmented construction permits dismantling for transportation, as will be understood. In its assembled form, the leading reference beam 26 generally has a length on the order of 20 to 30 feet and is supported at uniformly spaced intervals by a large plurality (10 in the illustration) of yieldably mounted shoes 30 (FIG. 2). To advantage, the shoes 30, may be made of flat sheet metal, pivotally connect at 31 to a yoke bracket 32 carried at the end of a guide bolt 33. A stabilizing link 34 is pivotally connected to the yoke 32 and extends forward to a lug bracket 35, to which it is pivotally connected at 36. The bolt 33 is slidably guided in a spherical bearing 37 received in a boss 38 formed on the reference beam 26. A spring 39 extends between the spherical bearing 37 and the top of the yoke 32, and is arranged to be compressed as a function of upward movement of the shoe 30 relative to the reference beam 26.

The arrangement of the several supporting shoe assemblies for the forward reference beam is such that, when the beam is resting on the base surface 25, in its normal operating arrangement, the springs 39 of all of the shoe assemblies are partially compressed. And, although the base surface 25 may not be precisely level throughout the length of the reference beam, and may contain minor aberrations in the form of small rises or depressions, the beam itself and particularly its midpoint, will tend to maintain an averaged position above the roadway, reflecting the average condition of the surface. As will be understood, individual shoe assemblies may rise or fall relative to the beam in following anomalies in the road surface. The reference beam itself will be influenced only to a minor extent by individual movements of the shoe assemblies, but will reflect an average condition. The geometric center of the beam, in terms of the location of the supports therefor, reflects most precisely the average reference condition sought to be determined.

Since the forward reference beam 26 is to be located entirely forward of the auger, the geometric center region of an adequately long reference beam is located far ahead of even the forwardmost extremity of the tow arm 17. Thus, in accordance with one aspect of the invention, the forward reference beam 26 is provided in its effective center region with a vertically extending bracket 49 which is pivotally connected at 40 to an elongated, rearwardly extending reference arm 41. In the illustrated system, the reference arm 41 includes an upward extension 42 which is pivotally connected at 43 to the upward extension 15 of the screed tow arm 17. Desirably, the pivot point 43 connecting the reference arm 41 to the screed tow arm is located rearward of the tow bracket 21 and at the same time well forward of the screed assembly 16. A point approximately midway between these areas is advantageous, inasmuch as vertical movement relative to the desired reference of either the screed assembly 16 or its tow point will be reflected in vertical movement of the pivot point 43 and a corresponding vertical movement of the reference arm 41.

The reference beam 26 is carried along with the paver frame 10 by means of a forward tow linkage 44, by which the beam is attached to the front of the paver. An articulated stabilizing linkage 45 connects the back of the reference beam 26 to a portion 46 of the paver frame (FIG. 5) to provide lateral stability.

The rear reference beam 27 typically may be somewhat shorter in length than the forward beam 26. For example, a beam length of 20 to 25 feet for the rear beam may be suitable, while a 30 foot length on the forward beam would be preferable. In the illustrated arrangement, the rear beam is constructed in two sections, bolted together at a center flange 47. The rear reference beam 27 is supported on a plurality of shoes 48 similar to those supporting the front beam 26.

The newly laid pavement mat 24 should have a higher degree of smoothness and levelness than the road bed 25, thus, it has been found that two shoes 48, one near the front and one near the rear of the beam 27, are adequate. Preferably, the two shoes should have a ground engaging surface area approximately three times the size of the forward shoes 30. It is advantageous in most cases that the plurality of shoes 48 for the rear reference beam be independently supported, so that the position of the beam reflects an average position of the shoes. To this end, the shoes may be supported much in the same manner as the shoes 30 of leading reference beam. The arrangement is such as to freely accommodate individual, yieldably resisted vertical movement of the shoes relative to the rigid beam.

Figure 4:
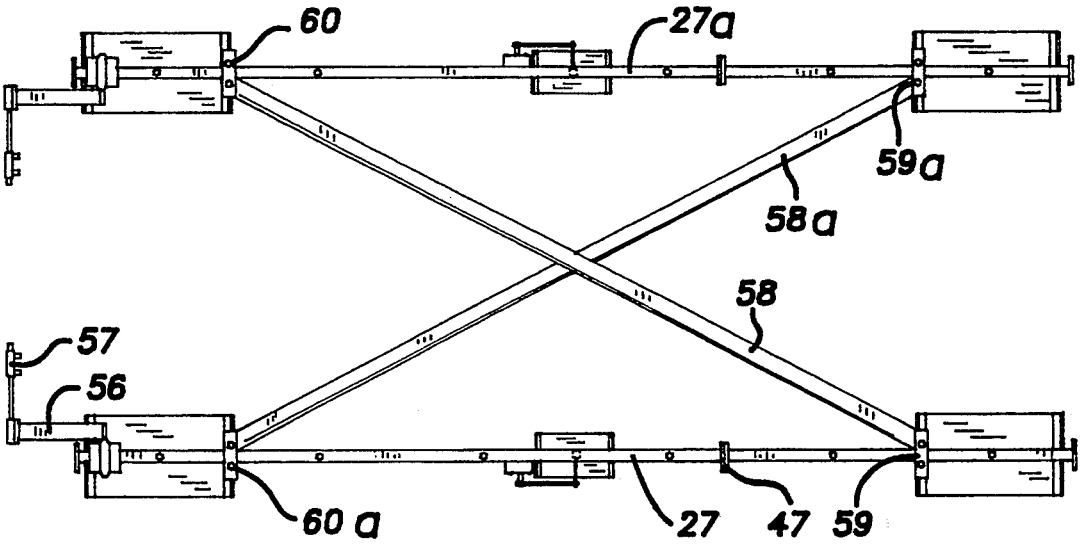
FIG. 4 is a top plan view illustrating features of the rear reference beam utilized in the apparatus of FIG. 1, and showing reference beams utilized on both sides of the paving machine.

The rear beam advantageously is towed from the screed assembly 16, by means of a pivoted tow link 56 (FIG. 4) extending rearwardly from a bracket 57 suitably attached to the screed. For lateral stabilization of the back of the trailing beam 27, there is provided a diagonal stabilizing linkage consisting of a tie rod 58 secured to the beam by a clamp 59 and extending forwardly to a connection point at the opposite side of the machine. In the arrangement shown in FIG. 4 of the drawings, the equipment is set up to employ reference beam systems on both sides of the paving machine. In that case, the stabilizing bar 58 for the reference beam 27 may be secured by a clamp 60 to the forward portion of the opposite side rear reference beam 27*a*. Likewise, the beam 27*a* will be stabilized by a tie bar 58*a* secured by clamps 59*a* and 60*a*. Where only a single rear reference beam is utilized, the stabilizing bar 58 can be connected more directly to the screed assembly 16.

Figure 3:
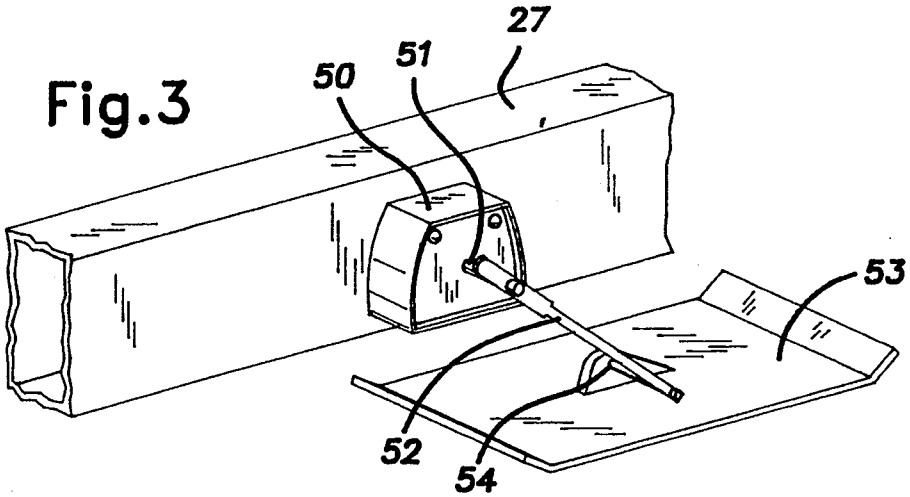
FIG. 3 is an enlarged perspective view showing details of a position sensor on the rear reference beam.

Referring to FIG. 3, a means to measure the distance from the rear beam to the fresh mat 24 is shown. A position sensor 50 is mounted near the center of the rear beam 27. The sensor is preferably a potentiometer. The sensor has a rotatable shaft 51 which is actuated by a lever or feeler 52. The feeler 52 is pivotally attached to a shoe 53 similar to the support shoes 30. Preferably, the pivot 54 should be at the centerline of the beam 27. The length of the feeler 52 should be such that it is at approximately a 45 degree angle behind the sensor 50 when the shoe is resting on the mat 24. The measuring means shown is preferred for its simplicity and ability to combine with a reference beam. Other means for measuring the distance from the beam to the fresh mat are contemplated. For example, an ultrasonic measuring device, a capacitive device or a light triangulation device could be mounted on the rear beam.

Alternatively, the measuring means can be separate from the reference beam 27 or can be used on a paver which does not include a reference beam. For example, a separate member could be towed behind the paver which would be supported like the rear beam to define a datum. The member would have the measuring means mounted thereon. Another embodiment would include a ground engaging means, such as a shoe, towed behind the paver with a sensor mounted thereon. The sensor would have a feeler contacting a stationary datum such as a string or beam of a type known in the art.

Figure 6:
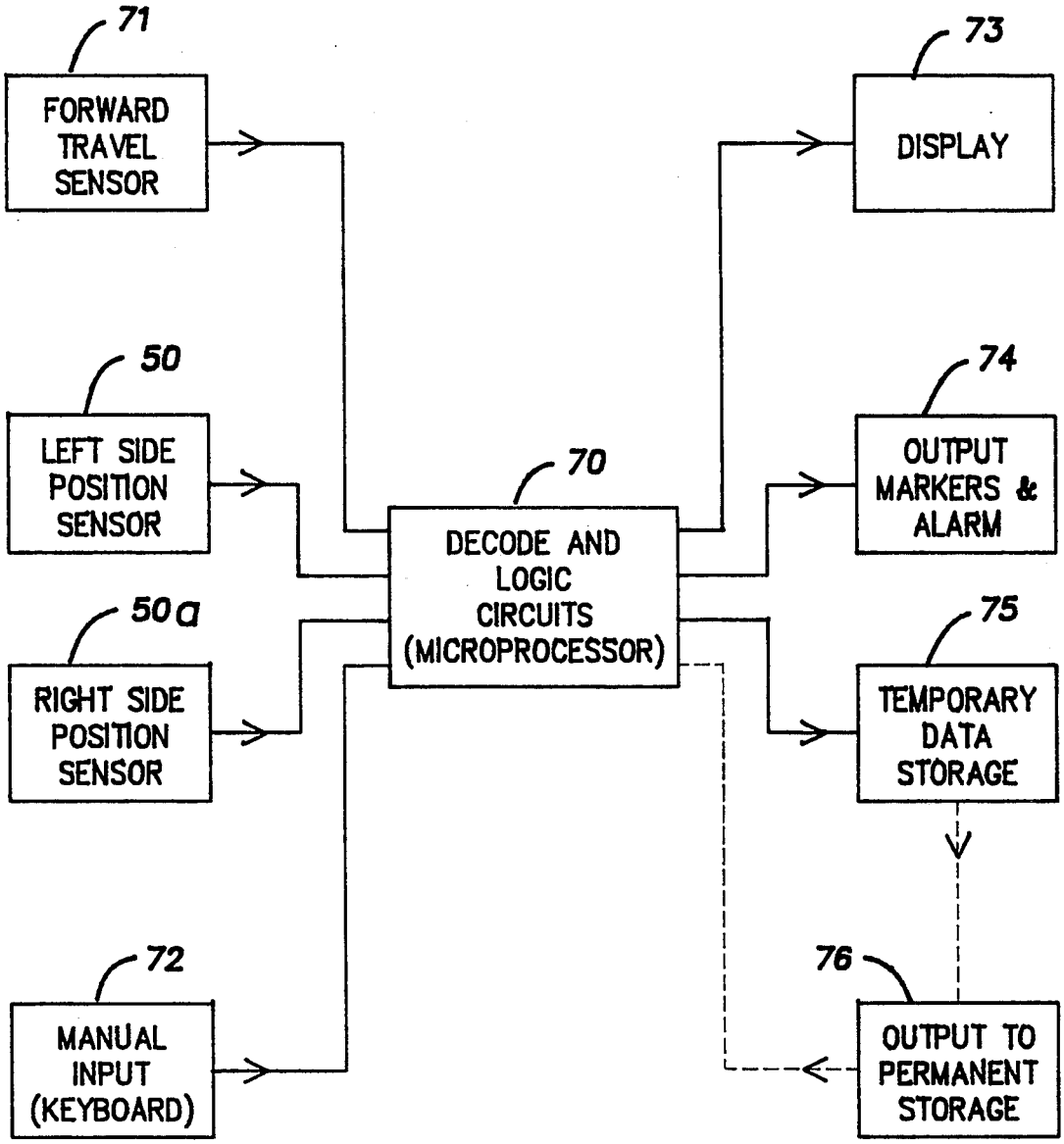
FIG. 6 is a block diagram of a smoothness sensing system in accordance with the invention.

With reference to FIG. 6, the sensor 50 and a position sensor 50*a* on the right side rear beam 27*a* are connected to a microprocessor based decode and logic circuit 70. A forward travel sensor 71 is mechanically connected to a wheel of the paver, for example, to sense the distance travelled by the paver. The travel sensor 71 is electrically connected to the logic circuits 70. A manual data input 72 such as a keyboard can also be connected to the logic circuits 70. The logic circuits have outputs to a visible display 73, output markers and alarms 74 and temporary data storage 75. The logic circuits are connectable to write to or read from a permanent storage 76. Alternatively, it is possible, for example, to have a mechanical sensor which is linked to a pen and paper plotter as is known. A grade/slope control circuit 77 can be connected to receive an input from the logic circuit 70.

In the effective center region of the beam 27, in terms of the location of the spaced supports, there is provided a vertically disposed extension bracket 61 which pivotally engages at 62 the trailing end of a reference arm structure 63. The reference arm structure 63 desirably is constructed in the form of a truss arranged to support an elongated, forwardly extending reference arm element 64. The specific configuration of the truss 63 is unimportant, apart from the fact that it must be consistent with its passing over the top of the screed and auger structures at the back of the paver.

In the illustrated arrangement, the reference arm 64 is attached by the pivot pin 43 to the forward reference arm 41. Within the purview of this invention, the forward and rear reference arms 41 and 64 could be separately pivoted to the tow arms 17, or they could be pivotally connected together and pivoted to the tow arm 17 at a different axis. However, a common pivot point at the pin 43 is simple and advantageous.

As is reflected in FIGS. 1 and 5, the rearward reference arm 64 extends forwardly well beyond the pivot pin 43, to a region located approximately over the center of the forward reference arm 41. The sensing device 28, typically in the form of a potentiometer actuated by a feeler element 65, is secured to the upper reference arm 64, by means of a clamping bracket 66. The bracket 66 may be secured in any of several positions along the length of reference arm 64, so as to be properly positioned with respect to the forward reference arm 41. In addition, the sensing device 28 has a vertically extendable support 67 adjustably secured in the clamp 66. As reflected in FIG. 5, the sensing device 28 may be vertically adjusted in the clamp 66 to a position in which the feeler element 65 bears upon the center region of the forward reference arm 41. When properly adjusted, the feeler element 65 will be approximately midway between its upper and lower extreme positions when the proper space relationship exists between the respective reference arms 41 and 64. Any change in the spacing between these arms, in the region of the sensor 28, will cause a displacement of the feeler 65, either upward or downward. In accordance with principles which are well known and need not be repeated here, movement of the potentiometer feeler element 65 away from its neutral position can be utilized to effect energization of the actuator 22 in a direction that will tend to restore the feeler to its neutral position by appropriate upward or downward movement of the tow arm 17, as may be necessary.

The reference arms 41 and 64 are arranged to be more or less horizontal and parallel when the respective leading and trailing reference beams are in a desired, predetermined relationship and the tow arms 17 are properly positioned. To this end, the vertical supports 39 and 61 may be provided with a plurality of openings or other adjustment facilities for establishing a desired level for the pivot points 40 and 62 of the respective reference arms.

When the system is in operation, the paver frame 10 advances forwardly (to the left in FIG. 1) carrying with it the reference beams 26 and 27, the former riding on the roadway base surface 25 and the latter riding on the fresh pavement mat 24. Assuming, for example, that the level of the paver frame 10 were to drop, relative to the reference, as by reason of an increased load in the hopper and/or one or more of the wheels moving into a minor depression in the roadway, the forward extremity of the tow arm 17, being attached to the paver frame through the hydraulic actuator 22, would be correspondingly lowered relative to the reference beams 26 and 27. This would in turn cause a lowering of the pivot point 43 and a resulting relative closing of the distance between the reference arms 41 and 64 in the region of the sensor 28. Immediately, the actuator 22 would be energized to raise the forward end of the tow arm 17 sufficiently to re-establish proper spacing between the reference arms. As a result, the orientation of the tow arms 17 to the roadway base surface 25 and to the pavement surface 24 is retained substantially constant, notwithstanding vertical deviations of the paver frame itself.

As will be appreciated, the screed assembly 16 is supported by flotation on the viscous asphalt paving material as the paver is advanced on the roadway. The viscosity and other characteristic nature of this material ideally should be constant at all times. As a practical matter, however, the consistency of the mixture may vary from truckload to truckload, and the viscosity characteristic of even the same mixture may vary somewhat as a function of temperature, for example. Accordingly, assuming the paving frame 10 itself is traveling a perfectly level course, there may be some tendency for the screed assembly 16 to deviate upwardly or downwardly in some measure from the desired paving level. When this occurs, it is reflected in upward or downward movement of the pivot point 43 and a corresponding change in the relationship of the reference arms 41 and 64. For example, if the screed assembly would tend to sink into the mat, as a result of a lowering of the material viscosity, a reduction in forward speed, or like circumstance, the pivot point 43 would be correspondingly lowered, and the distance between the reference arms and the region of the sensor 28 would be correspondingly reduced. The potentiometer feeler 65 would be displaced from its neutral position, energizing the actuator 22 and raising the forward extremity of the tow bar 17 to re-establish the proper spacing. In this respect, raising of the forward end of the tow bar would increase the angle of incidence of the screed bottom plate 68 with respect to the pavement mat, tending to cause the screed assembly 16 to seek a higher level and thereby reestablish the desired level of the pavement surface.

After the pavement has been leveled by the screed, the sensor shoe 53 rides over the mat 24. The rear beam 27 maintains an average height above the mat, while the shoe rises and falls with ridges and dips in the mat. In this way the sensor is rotated to indicate deviations from the average mat level.

The logic circuits are adapted to output a plot of position sensor 50 position as a function of paver position, which is output from the travel sensor 71. This plot provides a graph of smoothness. The logic circuits can also be adapted to analyze the smoothness graph, as is known, by applying an electronic "blanking hand." Alarms 74 can be activated by defined conditions such as "must fill" or "must grind" areas. Data and analysis can be stored in the temporary or permanent storage. The data can also be used to directly modify the grade and/or slope control 77.

In accordance with the embodiments described above, the essential method of providing immediate feedback of smoothness data includes the steps of distributing paving material with a moving paver, substantially levelling the paving material, establishing a reference line parallel with the direction of motion of the paver, and measuring the distance from the top of the levelled paving material to the reference line while the levelled paving material is plastic. The reference line can be established by a mobile beam, such as is described above, or it may be a stationary reference. The distance can be measured by mechanical means which contact the surface or by other means which do not contact the surface. Preferably, the measuring means follows directly behind the paver.

In this manner, immediate feedback of fresh mat smoothness is provided so that corrective action can be taken if necessary.

It should be understood, of course, that the specific form of the invention herein illustrated and described is intended to be representative only, as certain changes may be made therein without departing from the clear teachings of the disclosure. Accordingly, reference should be made to the appended claims in determining the full scope of the invention.

What is claimed is:

1. An apparatus for paving a base surface, comprising:

a movable vehicle capable of distributing paving material;

a floating screed disposed to form a substantially level mat of the paving material;

an elongated reference beam towed behind the screed;

ground engaging means for supporting the beam above the mat of paving material; and means to measure a distance from a reference point on the reference beam to the mat of paving material, said measuring means including:

a potentiometer mounted on the reference beam and having a rotatable shaft;

a lever attached to the potentiometer shaft;

a ground engaging member which can rest on the mat, pivotally attached to the lever so that vertical movement of the ground engaging member rotates the potentiometer shaft; and a means for indicating the position of the potentiometer as a function of a distance travelled by the paver.

2. An apparatus according to claim 1, wherein the reference beam is adapted to adjust the height of the screed in response to changes in the position of the screed relative to the beam.

3. A paver according to claim 2, further comprising a tow arm operatively connected between the vehicle and the screed to adjust the height of the screed, wherein the reference beam is operatively connected to control movement of the tow arm.

4. A paver according to claim 2, further comprising a forward reference beam disposed ahead of the screed and adapted to adjust the height of the screed in response to changes in the position of the reference beam relative to the screed.

5. A paver according to claim 1, wherein the ground engaging means comprises a plurality of shoes.

6. A paver according to claim 1, further comprising a sensor to measure forward travel of the paver.

7. An improved dual reference beam grade control system for use in combination with an asphalt paver of the type having a transversely disposed material distributing auger, a floating screed positioned behind the auger, two tow arms extending forwardly from the screed and connected to the paver frame, and tow arm suspension means for vertically adjusting the tow point connections of said tow arms to effect changes in the attitude angle of the screed, said grade control system having:

a first reference member towed by the paver frame and extending longitudinally along one side thereof, said first reference member being disposed entirely forward of the auger;

a plurality of ground engaging supports for said first reference member spaced along its length and supporting said reference member at an averaged position above a base grade surface;

a first reference arm pivotally connected to the first reference member in its central region and extending rearwardly toward and being pivotally connected to said tow arm;

a second reference member towed by the paver frame and being disposed entirely behind the screed;

ground engaging means for supporting said second reference member above an asphalt mat surface laid by the paver;

a second reference arm connected to the second reference member and extending forwardly toward and being pivotally connected to said tow arm and/or said first reference arm; and tow arm height reference control means associated with each of said reference arms and operatively associated with said tow arm suspension means for raising and lowering the tow point of said tow arm relative to the paver frame in response to relative movements of one or both of said reference arms in relation to said tow arm, wherein the improvement comprises:

a means to measure a distance from a reference point on the second reference member to the asphalt mat surface, said measuring means including:

a potentiometer mounted on the second reference beam and having a rotatable shaft;

a lever attached to the potentiometer shaft;

a ground engaging member which can rest on the fresh mat, pivotally attached to the lever so that vertical movement of the ground engaging member rotates the potentiometer shaft; and a means for indicating the position of the potentiometer as a function of a distance travelled by the paver.

8. A grade control system according to claim 7, wherein the reference point is on the vertical centerline of the second reference member.

9. A grade control system according to claim 7, wherein the indicating means includes a microprocessor-based circuit which receives input from the measuring means and a forward travel sensor and which outputs information to a display.

10. A grade control system according to claim 9, further comprising means to analyze the position information.

11. A grade control system according to claim 6, wherein an output of the analyzing means is connected to directly modify grade and/or slope control of the paver.

* * * * *

UNITED STATES PATENT AND TRADEMARK OFFICE

CERTIFICATE OF CORRECTION

PATENT NO. : 5,362,177

DATED : November 8, 1994

INVENTOR(S) : Garry Bowhall, et al.

It is certified that error appears in the above-identified patent and that said Letters Patent is hereby corrected as shown below:

Col. 6, line 17, insert "." after --arms--.

Col. 6, line 18, insert "," after --16--.

Col. 14, line 25, replace "6" with --10--.

Signed and Sealed this

Twenty-fifth Day of April, 1995

Bruce Lehman

*Attest:*

BRUCE LEHMAN

*Attesting Officer*

*Commissioner of Patents and Trademarks*